US009708227B2

(12) United States Patent
Alven

(10) Patent No.: US 9,708,227 B2
(45) Date of Patent: Jul. 18, 2017

(54) METHOD FOR PRODUCING A FRAGMENT / REACTIVE MATERIAL ASSEMBLY

(71) Applicant: Aerojet Rocketdyne, Inc., Rancho Cordova, CA (US)

(72) Inventor: David A. Alven, Johnson City, TN (US)

(73) Assignee: AEROJET ROCKETDYNE, INC., Rancho Cordova, CA (US)

( * ) Notice: Subject to any disclaimer, the term of this patent is extended or adjusted under 35 U.S.C. 154(b) by 0 days.

(21) Appl. No.: 14/195,033

(22) Filed: Mar. 3, 2014

(65) Prior Publication Data

US 2014/0360635 A1 Dec. 11, 2014

Related U.S. Application Data

(60) Provisional application No. 61/788,608, filed on Mar. 15, 2013.

(51) Int. Cl.

| | |
|---|---|
| ***C06B 45/00*** | (2006.01) |
| ***D03D 23/00*** | (2006.01) |
| ***D03D 43/00*** | (2006.01) |
| ***C06B 21/00*** | (2006.01) |
| ***F42B 12/32*** | (2006.01) |
| ***F42B 12/44*** | (2006.01) |
| ***F42B 12/74*** | (2006.01) |
| ***C06B 43/00*** | (2006.01) |
| ***B22F 3/10*** | (2006.01) |
| ***B22F 3/12*** | (2006.01) |
| ***B22F 5/00*** | (2006.01) |
| ***C22C 1/04*** | (2006.01) |
| ***C22C 33/02*** | (2006.01) |
| ***C06C 15/00*** | (2006.01) |

(52) U.S. Cl.

CPC ..... *C06B 21/0041* (2013.01); *B22F 3/1007* (2013.01); *B22F 3/1283* (2013.01); *B22F 5/00* (2013.01); *C06B 43/00* (2013.01); *C06B 45/00* (2013.01); *C06C 15/00* (2013.01); *C22C 1/045* (2013.01); *C22C 33/0207* (2013.01); *F42B 12/32* (2013.01); *F42B 12/44* (2013.01); *F42B 12/74* (2013.01); *B22F 2998/10* (2013.01); *B22F 2999/00* (2013.01)

(58) Field of Classification Search

USPC ..... 149/2, 108.2, 108.6, 108.8, 109.4, 109.6

See application file for complete search history.

(56) References Cited

U.S. PATENT DOCUMENTS

| | | | |
|---|---|---|---|
| 4,129,061 | A | 12/1978 | Bedall et al. |
| 4,858,531 | A | 8/1989 | Lindstadt et al. |
| 7,921,778 | B2 | 4/2011 | Stawovy |
| 8,361,258 | B2 | 1/2013 | Ashcroft et al. |

(Continued)

*Primary Examiner* — James McDonough

(74) *Attorney, Agent, or Firm* — Joel G Landau

(57) ABSTRACT

A method for the manufacture of a composite fragmenting material having exothermic properties includes the steps of packing a mold with preformed metal fragments; filling interstitial spaces surrounding the metal fragments with a reactive metal powder to form a mixture; and then sintering the mixture at a temperature effective to both coat the metal fragments with the reactive metal powder and to bond the metal fragments together. In one embodiment the composite fragmenting material is formed into a nosecone for a warhead.

6 Claims, 2 Drawing Sheets

Examples of various shapes possible with invention.

(56) References Cited

U.S. PATENT DOCUMENTS

| | | | | |
|---|---|---|---|---|
| 2010/0288151 | A1* | 11/2010 | Williams | F42B 12/22 102/364 |
| 2011/0064600 | A1* | 3/2011 | Brent | B22F 3/1035 419/28 |
| 2011/0094408 | A1 | 4/2011 | Dupont et al. | |
| 2012/0024180 | A1 | 2/2012 | Waddell et al. | |
| 2012/0255457 | A1 | 10/2012 | Hugus et al. | |

* cited by examiner

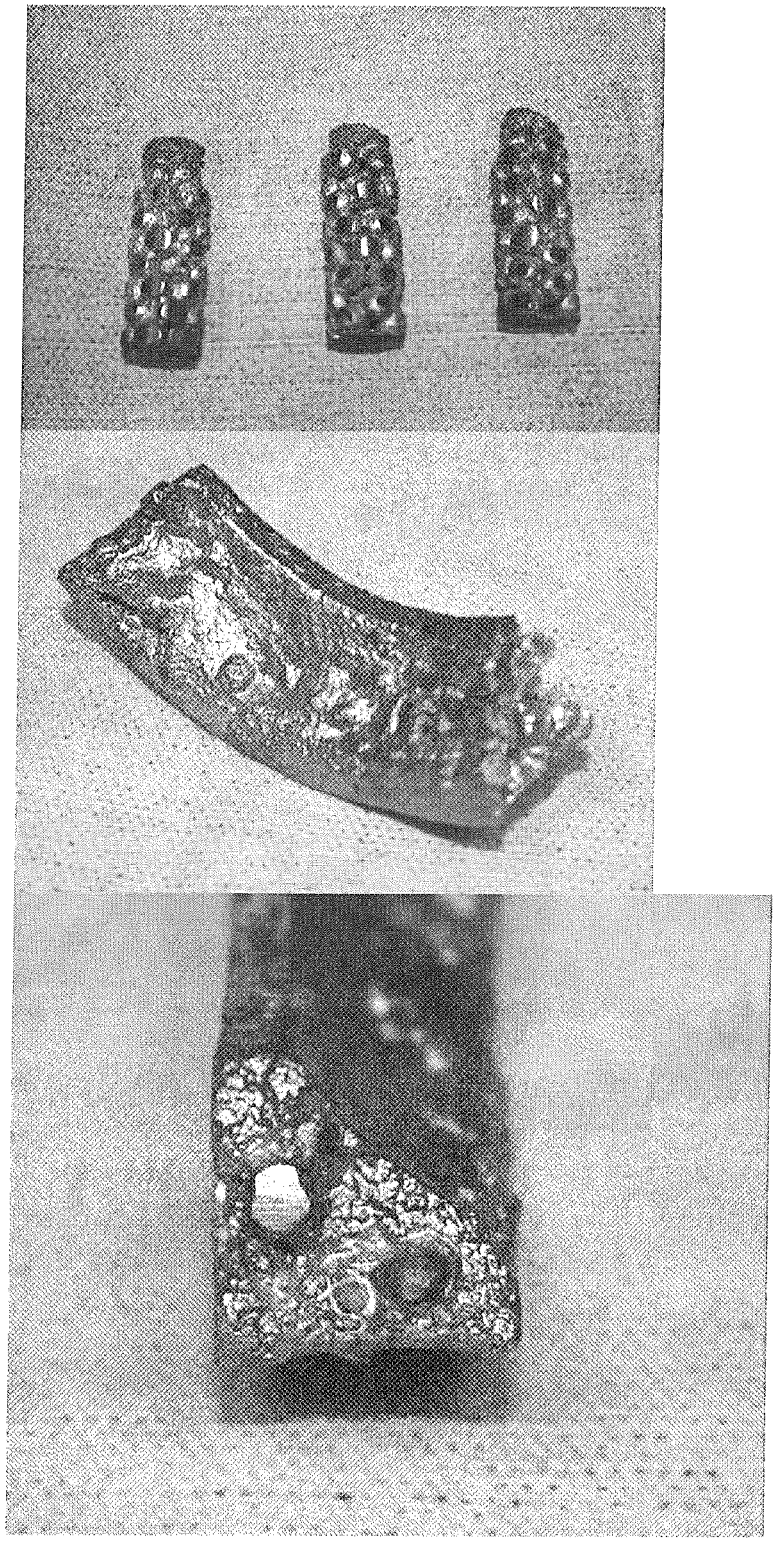
1A
1B
1C
Figure 1. Examples of various shapes possible with invention.

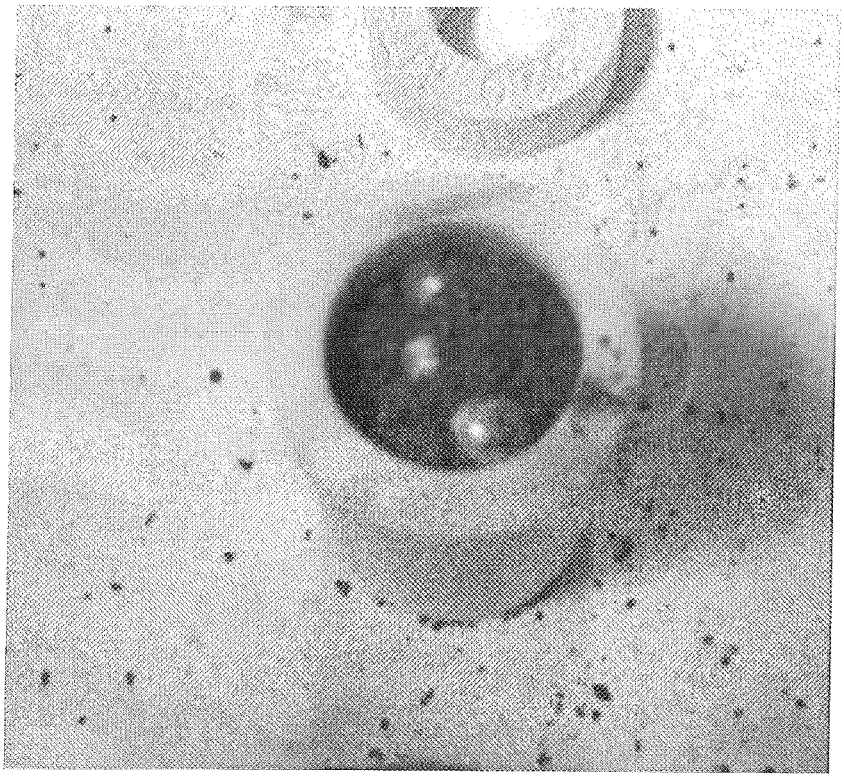
Figure 2. Example of a loaded right circular cylinder shape ready for sintering.
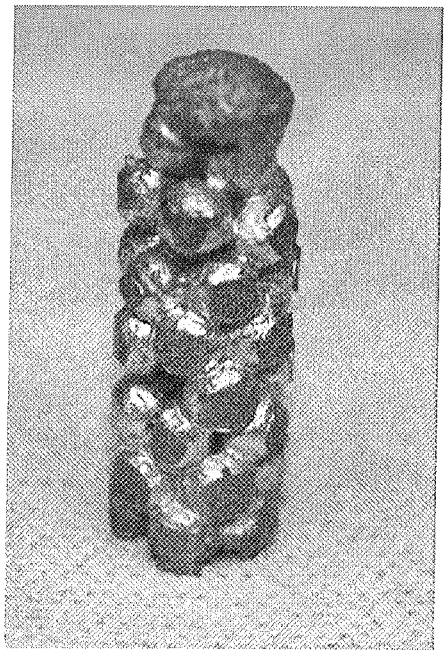
Figure 3. Results of sintering the mold shown in Figure 2.

METHOD FOR PRODUCING A FRAGMENT / REACTIVE MATERIAL ASSEMBLY

CROSS REFERENCE TO RELATED APPLICATION(S)

This patent application claims a benefit to the filing date of U.S. Provisional Patent Application Ser. No. 61/788,608 titled "Method for Producing a Fragment/Reactive Material Assembly." The disclosure of that provisional patent application is incorporated by reference herein in its entirety.

U.S. GOVERNMENT RIGHTS

N.A.

BACKGROUND

Field

Disclosed herein is method to manufacture a fragmenting material and the material so produced. More particularly, a composite material has metal fragments bonded together by a reactive metal, such as by sintering.

Description of the Related Art

The military has a need for devices that can be deployed from a safe distance and distribute a lethal cloud of fast-moving fragments on detonation. One such application is the nose cone of a fragmenting warhead. One such nose cone is a composite material having pre-defined shapes blended with a powder. The mixture is then compacted and sintered. This process is disclosed in United States Patent Application Publication No. US 2011/0064600 A1, titled "Co-Sintered Multi-System Tungsten Alloy Composite," by Brent et al. Another sintered product disclosed as useful for the liner of a shaped charge liner is disclosed in U.S. Pat. No. 7,921,778, titled "Single. Phase Tungsten Alloy for Shaped Charge Liner," by Stowovy. Both US 2011/0064600 A1 and U.S. Pat. No. 7,921,778 are incorporated by reference herein in their entireties.

BRIEF SUMMARY OF THE INVENTION

Disclosed herein is a method for the manufacture of a composite fragmenting material having exothermic properties that includes the steps of packing a mold with preformed metal fragments; filling interstitial spaces surrounding the metal fragments with a reactive metal powder to form a mixture; and then sintering the mixture at a temperature effective to both coat the metal fragments with the reactive metal powder and to bond the metal fragments together.

The details of one or more embodiments of the invention are set forth in the accompanying drawings and the description below. Other features, objects and advantages of the invention will be apparent from the description and drawings, and from the claims.

BRIEF DESCRIPTION OF THE DRAWINGS

FIGS. 1A-1C illustrate various shapes produced by the method disclosed herein.

FIG. 2 illustrates a loaded cylinder ready for sintering in accordance with a process step.

FIG. 3 shows the product produced by the loaded cylinder of FIG. 2 following sintering.

Like reference numbers and designations in the various drawings indicated like elements.

DETAILED DESCRIPTION

Disclosed herein is a method for manufacturing a fragment array with a reactive material coating. The fragments, which can be steel, tantalum, tungsten, tungsten heavy alloy, or a number of other materials, are loaded into a container, such as a ceramic sleeve or sagger. The fragments are densely packed based on their shape such as spheres, hexes, cubes or other manufacturable shapes. Typically, these fragments have a longest length (measured along an axis or diameter dependent on shape) of between 0.05 inch and 0.5 inch. The fragments can be preformed before insertion into the container by any suitable process, such as casting, sintering or machining. Suitable materials for the container are high temperature materials that are non-reactive with the reactive materials described below. Exemplary materials for the contained include alumina, mullite and ceramic fiber board.

Once packed in the container a reactive metal powder is mixed in and around the fragments. By reactive, it is meant a material that is exothermic on fragmentation of the warhead. Typically this will be a pyrophoric material that reacts with oxygen. The reactive material can be but is not limited to zirconium or a zirconium-base alloy. Other suitable reactive materials include niobium, hafnium, aluminum, titanium, magnesium and alloys containing more than 50%, by weight, of those metals. The reactive powder has a size from nanometers up to about 50 microns.

The container with the fragments and reactive material are then subjected to a high temperature sinter cycle whereby the reactive material coats the fragments and bonds them together to retain the shape of the container. While at temperature, the sintering is preferably under a vacuum of from about $10^{-3}$ torr to $10^{-6}$ torr, although an inert atmosphere could also be employed.

It was found that by making a mold material in a given shape such as right circular cylinder, ring, curved or flat plate or any other shape that could be thought of (see FIG. 1) a composite fragmenting material of desired shape may be formed. The first step in the process is building the mold. The mold can be, but does not have to be, made from a ceramic material. This ceramic material can be castable or machinable, it can be cloth or fiber board. For a right circular cylinder one method could use commercially available ceramic tubes. The tubes could be cut to one inch length segments. These tube segments would then be filled with a metal fragment such as, but not limited to, a tungsten heavy alloy, steel or other material sphere, cube or hexagon. Once the tube is filled with the fragments then a reactive material such as, but not limited to, Zirconium, in a powdered or sponge form is poured over the fragments such that the powder or sponge fills around the fragments (see FIG. 2).

The material is then placed in a furnace, be it an atmosphere or vacuum depending on the material to be sintered. The part is then heated to a point that is high enough to promote bonding of the reactive fill material with the fragments. One example would be the tungsten heavy alloy spheres with zirconium. In this example the filled molds are sintered in the temperature range of between 300° C. and 1600° C. and preferably at a temperature range of between 1200° C. to 1500° C. Once the sinter cycle is complete the bonded shape can be removed from the mold. The result is fragments that are bonded by a reactive material into a specific shape (FIG. 3). The shapes can be loaded into warheads to produce fragments that have a reactive nature when they interact with targets.

EXAMPLE

The process and products disclosed herein are demonstrated by the following Example. A combination of tungsten heavy alloy (WHA) spheres and zirconium metal was formed. 41 spheres were placed in an alumina tube having an opening that measured 1 inch long by 0.5 inch. The result was a 55% packing factor for the spheres. Then 2.6 grams of zirconium powder was shaken into the same alumina tube so that the zirconium powder surrounded the spheres and filled the interstitial vacancies. The assembly was then sintered under high vacuum (approx. $10^{-6}$ torr) to a temperature of 1250° C. The resultant composite was a free standing right circular cylinder of WHA spheres that were bonded and coated with zirconium.

The composite was then placed in a vented enclosure and a nichrome element wire was attached to increase the heat of the assembly. The nichrome element was electrified to increase the temperature of the composite to emulate the heat and energy that would be seen on detonation of a warhead. The fragmentation pack reacted to the increase of heat with an exothermic reaction and pyrophoric behavior.

One or more embodiments of the present invention have been described. Nevertheless, it will be understood that various modifications may be made without departing from the spirit and scope of the invention. Accordingly, other embodiments are within the scope of the following claims.

What is claimed is:

1. A method for the manufacture of a composite fragmenting material having exothermic properties, comprising the steps of:

packing a mold with preformed metal fragments;

filling interstitial spaces surrounding said metal fragments with a reactive metal powder to form a mixture; and sintering said mixture at a temperature effective to both coat said metal fragments with said reactive metal powder and to bond said metal fragments together, wherein the reactive metal powder is a material that is exothermic on fragmentation of a warhead.

2. The method of claim 1 wherein said reactive metal powder is selected to be pyrophoric in the presence of oxygen at temperatures reached during detonation of the warhead.

3. The method of claim 2 wherein said reactive metal powder is selected from the group consisting of zirconium, niobium, hafnium, aluminum, titanium, magnesium and alloys of those metals containing more than 50%, by weight, of those metals.

4. The method of claim 3 wherein said reactive metal is selected to be zirconium or a zirconium-base alloy.

5. The method of claim 4 wherein said mixture is sintered at a temperature of between 1200° C. and 1500° C.

6. The method of claim 5 wherein a vacuum of between $10^{-3}$ torr and $10^{-6}$ torr is applied to said mixture during the step of sintering.

* * * * *